US006316120B1

(12) United States Patent
Emslander

(10) Patent No.: US 6,316,120 B1
(45) Date of Patent: Nov. 13, 2001

(54) IMAGE RECEPTOR MEDIUM CONTAINING ETHYLENE VINYL ACETATE CARBON MONOXIDE TERPOLYMER

(75) Inventor: Jeffrey O. Emslander, Afton, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/253,647

(22) Filed: Feb. 20, 1999

(51) Int. Cl.[7] ..... B41M 5/00
(52) U.S. Cl. ..... 428/522; 347/105; 428/195
(58) Field of Search ..... 428/195, 411.1, 428/522; 347/105

(56) References Cited

U.S. PATENT DOCUMENTS

| | | | |
|---|---|---|---|
| 4,737,224 | 4/1988 | Fitzer et al. | 156/240 |
| 4,923,847 | 5/1990 | Ito et al. | 503/227 |
| 4,966,804 | 10/1990 | Hasegawa et al. | 428/203 |
| 5,114,520 | 5/1992 | Wang, Jr. et al. | 156/240 |
| 5,144,520 | 9/1992 | Parker et al. | 361/153 |
| 5,262,259 | 11/1993 | Chou et al. | 430/47 |
| 5,389,723 | 2/1995 | Iqbal et al. | 525/57 |
| 5,439,872 | 8/1995 | Ito et al. | 503/227 |
| 5,462,768 | 10/1995 | Adkins et al. | 427/265 |
| 5,472,789 | 12/1995 | Iqbal et al. | 428/483 |
| 5,721,086 | 2/1998 | Emslander et al. | 430/126 |
| 5,747,148 | 5/1998 | Warner et al. | 428/212 |
| 5,858,516 | 1/1999 | Ou-Yang | 428/195 |
| 6,015,603 * | 1/2000 | Ou-Yang | 428/195 |

FOREIGN PATENT DOCUMENTS

| | | |
|---|---|---|
| 0751005 | 1/1997 | (EP) . |
| 0767070 | 4/1997 | (EP) . |
| WO 98/04960 | 2/1998 | (WO) . |
| WO98/49604 | 11/1998 | (WO) . |
| WO98/49605 | 11/1998 | (WO) . |
| WO 98/55296 | 12/1998 | (WO) . |

* cited by examiner

*Primary Examiner*—Bruce H. Hess
(74) *Attorney, Agent, or Firm*—Carolyn V. Peters; John H. Hornickel

(57) ABSTRACT

An image receptor medium including an image reception layer having two major opposing surfaces. The image reception layer comprises a terpolymer of ethylene vinyl acetate carbon monoxide, optionally blended with at least one other polymer that can be wherein the image reception layer further comprises at least one other polymer blended with the terpolymer, wherein the other polymer is selected from the group consisting of ethylene vinyl acetate resins, ethylene (meth)acrylic acid copolymer resins, polyethylene resins, polypropylene resins, ionomers, acid-modified or acid/acrylate modified ethylene vinyl acetates and a polymer comprising at least two monoethylenically unsaturated monomeric units, wherein one monomeric unit comprises a substituted alkene where each branch comprises from 1 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature, and combinations of such other polymers thereof. Alternatively, the image receptor medium includes a substrate layer comprising a polymer substrate layer having two major opposing surfaces and an image reception layer on a first major surface of the substrate layer. The image reception layer has an outer surface for receiving images, and comprises a terpolymer identified above. Either embodiment of the image receptor medium may further include an optional prime layer, an optional adhesive layer, and an optional inkjet layer.

24 Claims, 1 Drawing Sheet

IMAGE RECEPTOR MEDIUM CONTAINING ETHYLENE VINYL ACETATE CARBON MONOXIDE TERPOLYMER

FIELD OF INVENTION

This invention relates to films useful as image receptor media for a variety of imaging materials such as inks and toners.

BACKGROUND OF THE INVENTION

Advertising and promotional displays often include graphic images appearing on structural surfaces such as truck sides and awnings, or free-hanging as banners. To prepare the display, an image may be formed on an adhesive-backed image receptor medium, sometimes referred to as a graphic marking film, which is then adhered to the desired substrate. Alternatively, the image may be formed first on a temporary carrier, or image transfer medium, and transferred to the image receptor medium. The image receptor medium usually includes a base material with an additional receptor layer overlying it. The base material is typically a plasticized vinyl film, although paper may also be used.

Although the graphic display may be intended for a long term installation of 5 years or more, it is often a relatively short term (3 months to 1 year) outdoor installation. In the case of a short term display, the image receptor medium is desirably a low cost, weather resistant, durable graphic marking film having good printability and adhesion of inks and/or toners that is easily applied to and removed from a surface. The vinyl base films currently used in graphic marking films are generally too costly for a short term application, and present other problems with plasticizer migration, plasticizer staining and adhesive anchorage. Paper-based media are not sufficiently durable or weather resistant and tear easily when removed. Polyolefin base films are low cost and contain no plasticizer but do not provide good ink/toner adhesion. The application of the receptor layer over the base film usually requires an additional process step, thus adding cost to the manufacturing process.

Images can be created by one of several known methods, such as electrography, screen printing, flexographic printing, lithographic printing, ink jet printing, and thermal mass transfer. Electrography involves passing a substrate, normally a dielectric material, through an electrographic printing device, one type of which is an electrostatic printer. In the printer, the substrate is addressed with static electric charges (e.g., as from a stylus) to form a latent image which is then developed with suitable toners. This technique is especially suitable for producing large scale images for use on posters and signs.

At the conclusion of the electrographic process where the toned image has been developed on the dielectric substrate, the printed substrate can be enclosed between two layers of clear vinyl plastic film and used directly in an outdoor application, such as a sign. Because the typical dielectric substrates are paper-based, however, they frequently lack the weather resistance required for outdoor signs. More durable substrates such as polyvinylchloride (PVC) and polyvinylacetate (PVA) films are difficult to image directly because of their electrical and mechanical properties.

To produce large signs that are suitable for outdoor display, the toned image electrographically deposited on a dielectric substrate can be transferred to a more weather resistant image receptor medium. The dielectric substrate is then known as an image transfer medium. This technique is discussed in U.S. Pat. No. 5,262,259. Image transfer may also be practiced with images created by a variety of other known techniques such as knife coating, roll coating, rotogravure coating, screen printing, and the like.

Transfer of the image from an image transfer medium to an image receptor medium typically requires the application of pressure and heat through, for example, lamination in a heated pressure roll system (hot roll lamination). This type of image transfer system is described in U.S. Pat. No. 5,114,520.

Images may also be created directly on a weatherable, durable image receptor medium using such techniques as screen printing and inkjet printing.

The inkjet printing process is now well known. Recently, wide format printers have become commercially available, making feasible the printing of large format articles such as posters, signs and banners. Inkjet printers are relatively inexpensive as compared with many other hardcopy output devices, such as electrostatic printers. Generally, thermal inkjet inks are wholly or partially water-based, whereas piezo inkjet inks can be solventless or solvent-based. Inkjet images may be printed on plain paper or on a suitable image receptor medium that has been treated or coated to improve its inkjet receptor properties. For example, it is known to apply an additional layer of material to an image receptor medium to improve the receptivity to and adhesion of thermal inkjet inks. The materials commonly found in such an inkjet reception layer do not generally adhere well to many image receptor media base films, such as vinyl or polyester.

Print shops or graphic arts facilities that operate more than one type of printing process must stock a different image receptor medium for each process. Because of this, the inventory of receptor media can be large and expensive.

The industry is addressing a need for low-cost, durable, weather resistant image receptor media that can be used with a variety of inks and toners, such as those disclosed in U.S. Pat. No. 5,721,086 (Emslander et al.).

SUMMARY OF THE INVENTION

There is a need for a low-cost, durable, weather resistant image receptor medium that can be used with a variety of inks and toners and will accept such toners and inks without pretreatment of the receptor medium.

The present invention solves the problems in the art with a film for use as an image receptor medium with a variety of printing and image transfer processes, and a variety of imaging materials such as inks and toners. The image receptor medium accepts images without the need for corona treatment, surface modification or other pretreatment. The present invention benefits from the use of ethylene vinyl acetate carbon monoxide terpolymeric resins to provide excellent screenprint ink receptivity without the requirement of corona treatment. These resins are so effective at promoting screenprint ink adhesion that such resins can be diluted by blending with other resins to produce the same results for ink adhesion with the other resins contributing other desirable physical or chemical properties.

Preferably, the ethylene vinyl acetate carbon monoxide terpolymers are blended with other resins, such as ethylene vinyl acetate resins, ethylene (meth)acrylic acid copolymer resins, polyethylene resins, polypropylene resins, ionomers, ethylene methyl acrylate resins or acid-modified or acid/acrylate modified ethylene vinyl acetate resins to increase viscosity of the resulting blended resin. Increased viscosity improves manufacturing operations, especially extrusion manufacturing, for making receptor media of the present invention. Further choices for co-blended resins include those that are less expensive than ethylene vinyl acetate carbon monoxide terpolymeric resins that do not diminish the ink adhesion properties of the imaging layer.

In one aspect, the image receptor medium includes an image reception layer having two major opposing surfaces. The image reception layer comprises a ketone ethylene ester, preferably an ethylene vinyl acetate carbon monoxide terpolymer. Preferably, but optionally, the image reception layer includes an efficacious amount of a free-radical scavenger such as a hindered amine light stabilizer compound ("HALS" compound). The image reception layer provides properties of image receptivity to the image receptor medium. "Image receptivity" means that an image formed on or applied to the image receptor medium adheres completely or nearly completely after being subjected to a tape snap test in which 3M SCOTCH™ Tape No. 610 (commercially available from 3M Company, St. Paul, Minn., USA) is firmly applied to the image and then removed with a rapid jerking motion. A prime layer is optionally included on a first major surface of the image reception layer. In this case, the second major surface of the image reception layer is an outer surface for receiving images.

In another aspect, the image receptor medium includes a polymer substrate layer having two major surfaces and an image reception layer on one major surface of the substrate layer. The image reception layer has an outer surface for receiving images and comprises a polymer described above. The image receptor medium can further include an optional prime layer on the major surface of the substrate layer opposite the image reception layer for promoting a strong bond between the substrate layer and an optional adhesive layer. The adhesive layer, preferably comprising a pressure sensitive adhesive, makes the multilayered film useful as a graphic marking film. The prime layer may also by itself serve as an adhesive layer.

In the case where the image receptor medium includes a substrate layer, the image receptor medium can advantageously combine the best properties of several resins in the various layers while minimizing the use of the most expensive resins, leading to a higher value and lower cost image receptor medium. For example, the substrate layer is made with resins of generally low cost that can be chosen to provide specifically desired physical properties to the multilayered film. These properties may include dimensional stability, tear resistance, ability to withstand ultra-violet light (UV) used for curing inks that are used for forming images, conformability, elastomeric properties, die cuttability, stiffness and heat resistance.

The image receptor medium can be made of only nonhalogenated polymers, meaning that certain regulatory limitations are avoided in the disposal of waste materials (pertaining for example to polyvinyl chloride (PVC)). The image receptor medium exhibits image receptivity with a wide variety of printing materials such as screenprint inks, electrographic liquid and dry toners, thermal mass transfer materials, and inkjet inks (if the optional inkjet layer is present).

The image receptor medium need not contain plasticizers in any of its layers, thereby avoiding problems associated with plasticizer migration and plasticizer staining. The image receptor medium is especially useful as a graphic marking film or banner film for relatively short-term advertising and promotional displays, both indoors and outdoors.

In another aspect, the invention provides a method of making an image receptor medium that involves providing at least two charges, each charge comprising at least one film-forming resin; coextruding the charges to form a multilayered coextrudate, wherein each layer of said coextrudate corresponds to one of the charges; and biaxially stretching the coextrudate to form a multilayered film comprising a nonplasticized polymer substrate layer having two opposing major surfaces; and an image reception layer on a first major surface of the substrate layer. The image reception layer has an outer surface for image reception and comprises ethylene vinyl acetate carbon monoxide terpolymer typically blended with at least one other polymer as described above.

In another aspect, the invention provides several methods of providing an image on an image receptor medium. In all of the methods, the image receptor medium includes a nonplasticized substrate layer and an image reception layer comprising the ethylene vinyl acetate carbon monoxide terpolymer by itself, or blended with at least one other polymer as described previously. A first method involves forming an image on an image transfer medium via electrography and transferring the image on to the image receptor medium. Other methods involve screen printing the image on the image receptor medium, thermal or piezo inkjet printing the image on the image receptor medium, flexographic printing of the image on the image receptor medium, lithographic printing of the image on the image receptor medium, and forming the image by thermal mass transfer on the image receptor medium.

A feature of the present invention is the use of a polymer that contains a carbon monoxide moiety of the terpolymer introduces additional polarity into the composition of the image receptor medium, which is believed to provide the increased ink adhesion.

Another feature of the present invention is that the use of the ethylene vinyl acetate carbon monoxide terpolymer avoids surface treatments such as corona treatments, which corona treatments can lose effectiveness within the duration of the contemplated usage of an image graphic.

An advantage of the present invention is that ethylene vinyl acetate carbon monoxide terpolymeric resin is commercially available at reasonable expense.

Embodiments of the invention are described in connection with the following drawings.

EMBODIMENTS OF THE INVENTION

Figure 1:
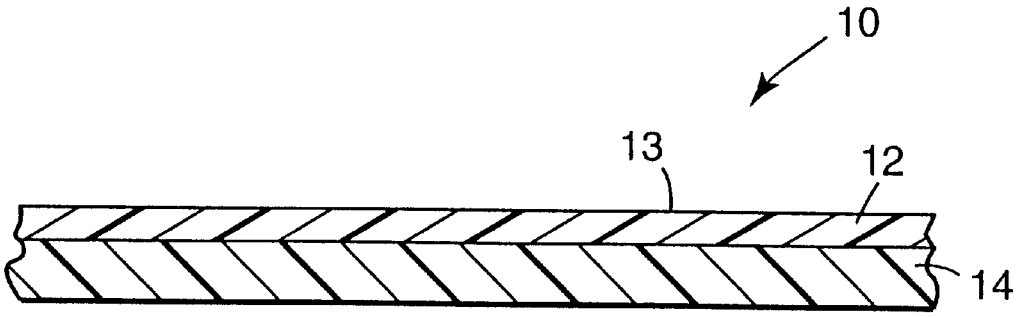
FIG. 1 is a schematic cross-sectional view illustrating an embodiment of the image receptor medium of this invention including an image reception layer and a substrate layer.

In one embodiment, the image receptor medium of this invention comprises a single image reception layer having two major surfaces. In another embodiment, as shown in FIG. 1, the image receptor medium 10 comprises a substrate layer 14 having two major surfaces and an image reception layer 12 overlying and in contact with one surface of the substrate layer as illustrated in FIG. 1. Image reception layer 12 has an outer surface 13 for receiving images.

Image Reception Layer

Image reception layer 12 comprises a ketone ethylene ester and preferably an ethylene vinyl acetate carbon monoxide ("EVACO") terpolymer alone or blended with another polymer. The ethylene vinyl acetate carbon monoxide terpolymer is commercially available from such sources as DuPont of Wilmington, Del., USA under the brand Elvaloy™ resin.

As identified by DuPont in its Web Site, "www.dupont.com", for Elvaloy™ resin, Elvaloy™ resin modifiers give long-lasting toughness and flexibility to materials such as highway pavement, roofing and geomembranes, plastic resins, underground pipe liners, and wire and cable jacketing. A key performance ingredient in such applications, Elvaloy™ often replaces liquid plasticizers or other lower-performing flexibilizers which can oxidize or migrate out of the material, leading to premature embrittlement. Elvaloy™ resin is a solid-phase thermoplastic modifier that locks itself into the molecular structure of base materials such asphalts, polyvinyl chloride plastics and alloys, and Acrylic-Butadiene-Styrene (ABS) plastics and alloys. Compounded with these materials, Elvaloy™ improves processing and imparts permanent flexibility. The DuPont Internet Web Site also identifies a variety of grades and extrusion techniques for which Elvaloy™ resins are suitable. Presently preferred is Elvaloy™ 741 grade resin.

The amount of the three monomers in the terpolymer can range from about 50% to about 80% and preferably from about 65% to about 75% weight percent of ethylene monomer; from about 10% to about 30% and preferably from about 20% to about 24% weight percent of vinyl acetate monomer; and from about 4% to about 15% and preferably from about 8% to about 10% carbon monoxide monomer.

The other polymer that can be blended with EVACO polymer typified by Elvaloy™ resin can be any polymer that is effective in use with the EVACO including without limitation, ethylene vinyl acetate resins, ethylene (meth) acrylic acid copolymer resins, polyethylene resins, polypropylene resins, ionomers, ethylene methyl acrylate resins or acid-modified or acid/acrylate modified ethylene vinyl acetate resins. The acrylate resins are more broadly disclosed as having at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature.

Nonlimiting examples of the first monomeric units include ethylene, propylene, butene, isobutylene, hexene, octene, and the like. Nonlimiting examples of the second monomeric units include methyl(meth)acrylate, ethyl(meth) acrylate, butyl(meth)acrylate, 2-ethylhexyl acrylate, ethoxyethyl acrylate, hexyl acrylate, and the like.

Of these polymers, ethylene methyl acrylates (EMAc) and ethylene ethyl acrylates (EEAc) are preferred because of their commercial availability. The polymer can be a random or block copolymer Preferably, the number of carbon atoms ranges from 2 to about 4 for the first monomeric unit and from 4 to about 8 for the second monomeric unit although the number of carbon atoms can be the same or different, and a mixture of different carbon length monomers can be used.

The quantity of polymers of the present invention in the image reception layer is preferably maximized within the limits of performance requirements of the image receptor medium. Routine efforts could be needed to optimize this quantity. The optimum quantity will depend upon the desired application and the targeted cost for the image receptor medium.

The blend weight ratio of EVACO:Other Polymer can be from 100:0 to about 5:95 and preferably from about 85:15 to about 15:85 and most preferably about 80:20 to 20:80, the desired ratio depending significantly on the chemical properties of the other resin blended with the EVACO resin and can be determined without undue experimentation by one skilled in the art. The performance of the polymers of the present invention may be affected by other additives in the image reception layer.

The polymers of the present invention in the image reception layer provides image receptivity to a wide variety of imaging materials used in electrography, screen printing, thermal mass transfer or other printing processes. The polymers of the present invention are preferably capable of being extruded or coextruded into a substantially two-dimensional sheet and bonding without delamination to an adjacent substrate layer when the layers are coextruded or laminated. Alternatively, the polymers may be in the form of a dispersion capable of being coated onto a substrate layer by a method such as roll coating.

In the case where an image is transferred to the image receptor medium having both an image reception layer and a substrate layer from an image transfer medium by a method such as hot roll lamination, the image reception layer preferably remains fully attached to the substrate layer and shows minimal tendency to adhere to non-imaged portions of the image transfer medium.

The image reception layer may also contain other components such as pigments, fillers, ultraviolet (UV) stabilizing agents, antiblocking agents, antistatic agents, and carrier resins for additives such as pigments, all of which are familiar to those skilled in the art. These additives are preferably chosen so as not to interfere with image receptivity.

A preferred additive to the image reception layer is a free-radical scavenger present in an amount from about 0.05% to about 1.5% and preferably from about 0.2 to about 0.8 weight percent of the total composition of the image receptor layer. Nonlimiting examples of the scavenger include hindered amine light stabilizer (HALS) compounds, hydroxylamines, sterically hindered phenols, and the like. Preferably, the free-radical scavenger is regenerating such as existing with the HALS compounds.

Especially significant and unexpected is the increased adhesion of UV curing ink systems after the film has been exposed several times to intense UV ink curing radiation as commonly occurs with UV screenprinting. With many current graphic films, a problem occurs when multiple colors are printed with UV curing inks onto a graphic marking film. As each color is printed, the graphic is passed under a bank of high intensity UV lights to cure the most recently applied ink. After several passes it becomes difficult for the UV ink to bond to the film in the unimaged areas and poor ink adhesion results. There are several ways to increase ink adhesion after this occurs but all require extra processing steps and the associated increased costs all of which are undesirable. A film which maintains ink adhesion after multiple passes through a UV ink curing oven is desirable because it would lead to fewer processing steps and lower costs. In addition, some graphic fabricators would be allowed to increase the number of colors used in their graphics due to the lower cost of printing many colors without the additional processing steps required if the film is sensitive to multipass UV exposure.

If image reception layer 12 is used with a substrate layer 14, image reception layer 12 is relatively thin as compared to substrate layer 14, and preferably has a thickness in the range from 2.5 to 127 microns (0.1 to 5 mils). If image reception layer 12 is not associated with a substrate layer 14, then image reception layer 12 may need to be thicker than the above-described range to provide sufficient durability and dimensional stability for the intended application. A thicker image reception layer can increase the overall cost of the image receptor medium.

Optional Substrate Layer

In one embodiment, a substrate layer 14 is included in the image receptor medium, for example to reduce the cost and/or enhance the physical properties of the medium. The substrate layer is most commonly white and opaque for graphic display applications, but could also be transparent, translucent, or colored opaque. Substrate layer 14 can comprise any polymer having desirable physical properties for the intended application. Properties of flexibility or stiffness, durability, tear resistance, conformability to non-uniform surfaces, die cuttability, weatherability, heat resistance and elasticity are examples. For example, a graphic marking film used in short term outdoor promotional displays typically can withstand outdoor conditions for a period in the range from about 3 months to about one year or more and exhibits tear resistance and durability for easy application and removal.

The material for the substrate layer is preferably a resin capable of being extruded or coextruded into a substantially two-dimensional film. Examples of suitable materials include polyester, polyolefin, polyamide, polycarbonate, polyurethane, polystyrene, acrylic, and polyvinyl chloride. Preferably, the substrate layer comprises a nonplasticized polymer to avoid difficulties with plasticizer migration and staining in the image receptor medium. Most preferably, the substrate layer comprises a polyolefin that is a propylene-ethylene copolymer containing about 6 weight % ethylene.

The substrate layer may also contain other components such as pigments, fillers, ultraviolet stabilizing agents, slip agents, antiblock agents, antistatic agents, and processing aids familiar to those skilled in the art. The substrate layer is commonly white opaque, but may also be transparent, colored opaque, or translucent.

A typical thickness of the substrate layer 14 is in the range from 12.7 to 305 microns (0.5 mil to 12 mils). However, the thickness can be outside this range providing the resulting image receptor medium is not too thick to feed into the printer or image transfer device of choice. A useful thickness is generally determined based on the requirements of the desired application.

Optional Prime Layer

Figure 2:
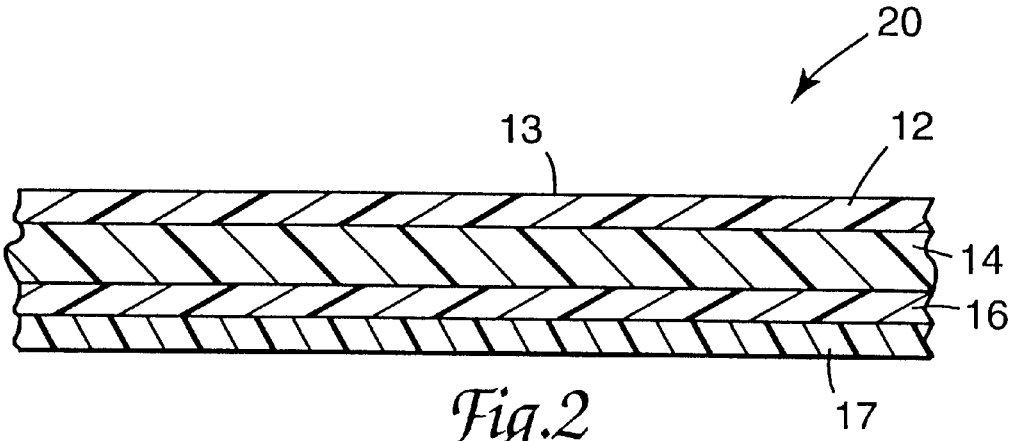
FIG. 2 is a schematic cross-sectional view illustrating the image receptor medium of this invention including the layers shown in FIG. 1 and an optional prime layer.

As illustrated in FIG. 2, optional prime layer 16 is located on the surface of substrate layer 14 opposite image reception layer 12. In the case where the image receptor medium does not include a substrate layer (not shown), the prime layer is located on the surface of the image reception layer 12 opposite the outer surface 13. The prime layer serves to increase the bond strength between the substrate layer and an adhesive layer 17 if the bond strength is not sufficiently high without the prime layer. The presence of an adhesive layer makes the image receptor medium useful as a graphic marking film. Although it is preferable to use a pressure sensitive adhesive, any adhesive that is particularly suited to the substrate layer and to the selected application can be used. Such adhesives are those known in the art and may include aggressively tacky adhesives, pressure sensitive adhesives, repositionable or positionable adhesives, hot melt adhesives, and the like.

The adhesive layer 17 is preferably covered with a release liner (not shown) that provides protection to the adhesive until the image receptor medium is ready to be applied to a surface.

Prime layer 16 may also by itself serve as an adhesive layer in some applications. The prime layer preferably comprises an ethylene vinyl acetate resin containing from about 5 weight % to about 28 weight % vinyl acetate, and a filler such as talc to provide a degree of surface roughness to the prime layer. The filler helps prevent blocking and promotes adhesion of the adhesive. The filler is generally present in an amount in the range from about 2 % to about 12 % by weight, preferably about 4 % to about 10 % by weight, and more preferably about 8 % by weight. The layer may also contain other components such as pigments, fillers, ultraviolet stabilizing agents, antiblock agents, antistatic agents, and the like.

Optional Inkjet Layer

Figure 3:
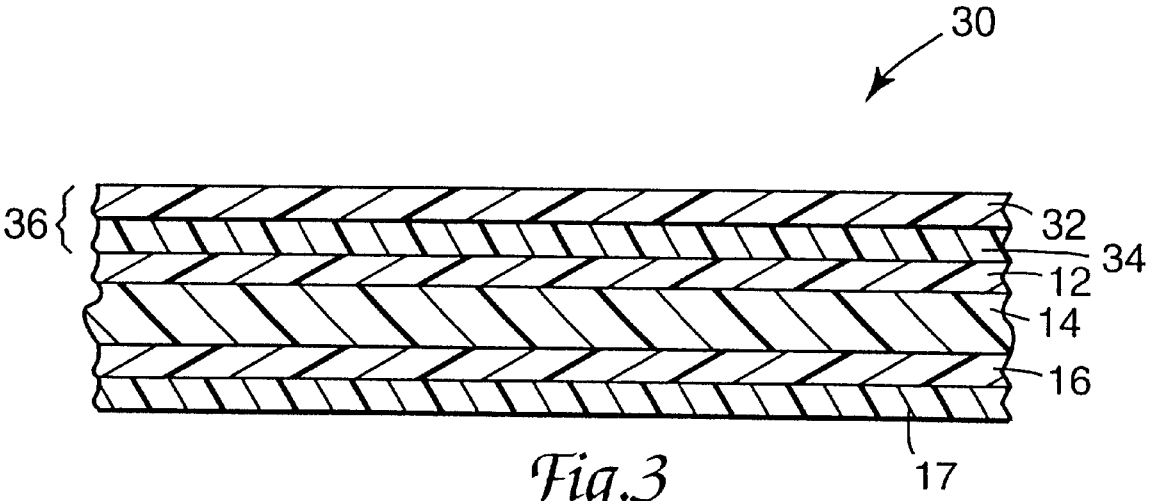
FIG. 3 is a schematic cross-sectional view illustrating the image receptor medium of this invention including the layers shown in FIG. 1, an optional prime layer and an optional inkjet layer.

FIG. 3 illustrates an image receptor medium having the same features as shown in FIG. 2, with the addition of an optional inkjet layer 36 on the outer surface 13 of the image reception layer 12. The inkjet layer is preferably used when the image receptor medium will receive images from a thermal ink jet printer using water-based inkjet inks (either dye-based or pigment-based) to provide characteristics of dye bleed resistance, low fading, uniform fading and rapid drying. In one embodiment, the inkjet layer comprises at least two layers 32 and 34. The uppermost layer 32, or top coat layer, functions as a protective penetrant layer to rapidly take up the water-based ink while the bottom coat layer 34 functions as an inkjet receptor. The bottom coat layer contains dispersed particles of a size such that the surface of the top coat layer exhibits protrusions or is roughened. The dispersed particles are preferably cornstarch or a modified cornstarch. The formulation of such inkjet layers is described in U.S. Pat. No. 5,747,148 (Warner et al.). Alternatively, the inkjet layer may comprise a single layer (not shown) such as described U.S. Pat. Nos. 5,389,723 and 5,472,789. All of these three patents are incorporated by reference herein.

This invention can include other layers in addition to the image reception layer 12, the substrate layer 14, the optional prime layer 16, the optional adhesive layer 17, and the optional inkjet layer 36. Additional layers may be useful for adding color, enhancing dimensional stability, promoting adhesion between dissimilar polymers in the above-described layers, and the like. After the image receptor medium has been printed with an image, an optional protective overlaminate layer (not shown) may be adhered to the printed surface. The overlaminate layer improves weather resistance of the film by helping to protect the film from ambient humidity, direct sunlight and other weathering effects, as well as protecting the image from nicks, scratches, and splashes. In addition, the overlaminate layer can impart a desired finish to the image, such as high gloss or matte. Suitable overlaminate layers include any suitable transparent plastic sheet material bearing an adhesive on one surface. Use of such overlaminate layers is, for example, described in U.S. Pat. No. 4,966,804, incorporated by reference herein.

Making the Image Receptor Medium

The image receptor medium of this invention can be made by a number of methods. For example, layers 12 and optional layers 14 and 16 can be coextruded using any suitable type of coextrusion die and any suitable method of film making such as blown film extrusion or cast film extrusion. Adhesive layer 17 may be coextruded with the other layers, transferred to the image receptor medium from a liner, or directly coated onto the image receptor medium in an additional process step. For the best performance in coextrusion, the polymeric materials for each layer are chosen to have similar properties such as melt viscosity. Techniques of coextrusion are found in many polymer processing references, including Progelhof, R. C., and Throne, J. L., "Polymer Engineering Principles", Hanser/Gardner Publications, Inc., Cincinnati, Ohio, 1993. Alternatively, one or more of the layers may be extruded as a separate sheet and laminated together to form the image receptor medium. One or more of the layers may also be formed by coating an aqueous or solvent-based dispersion onto one or more previously extruded layers. This method is less desirable because of the extra process steps and the additional waste involved.

The finished image receptor medium does not require surface treatment methods such as corona treatment to improve the image receptivity of the image receptor medium for certain applications, as described in the prior art.

Use of the Image Receptor Medium

The imaging materials that can be used in accordance with the present invention are particulate and semicrystalline or amorphous materials comprising a film-forming or resinous binder that is generally a thermoplastic. The imaging materials also contain pigments or dyes to provide contrast or color to the deposited image. Inks and toners are examples of well known imaging materials. The imaging materials may be deposited by a variety of known techniques such as electrography, screen printing, knife or roll coating, rotogravure coating, and the like.

An example of an imaging process using the image receptor medium of the present invention comprises first generating a toned image on an image transfer medium in an electrostatic printer using techniques and materials such as those described in U.S. Pat. No. 5,262,259, the disclosure of which is incorporated by reference, and then transferring the image to the image receiving surface of the image receptor medium. The image transfer can be accomplished in many ways known in the art such as passing the sheets together through heated nip rolls in a method known as hot roll lamination, or placing the sheets together on a heated platen in a vacuum drawdown frame. Hot roll lamination is described in U.S. Pat. No. 5,144,520, the disclosure of which is incorporated by reference. The imaged medium is then preferably covered with an overlaminate layer. If the multilayered film includes an adhesive layer and a release liner, the release liner may be removed and the imaged medium affixed to a wall, vehicle side, banner, or other surface using techniques well known in the art.

In another example of an imaging process, the image receptor medium is screen printed directly, thereby receiving the desired image without the extra image transfer step. The techniques and materials for practicing screen printing are described in U.S. Pat. No. 4,737,224, the disclosure of which is incorporated by reference herein. The imaged film is then used as described above. The image reception layer of the present invention is particularly suitable for screen printing because the image reception layer is extremely tolerant of the effects of UV light used to cure solventless inks used in screen printing. An example of such inks is disclosed in U.S. Pat. No. 5,462,768, which disclosure is incorporated by reference herein.

In another example of an imaging process, the image receptor medium is fed into an inkjet printer, printed directly with the desired image, and then overlaminated and applied as described above. The inkjet printer can print using either thermal inkjet inks (requiring optional ink jet receptor) or piezo inkjet inks. Thermal inkjet printers include those made by Hewlett Packard Corporation of Palo Alto, Calif., USA. Piezo inkjet printers include those made by Idanit Technologies, Ltd. of Rishon Le Zion 75150 Israel.

In another example of an imaging process, the image receptor medium is printed directly with an image via a thermal mass transfer process, using a device such as a GERBER EDGE thermal transfer printer (Gerber Scientific Products, Inc., Manchester, Conn., USA). The image film is then used as described above.

The present invention avoids a concern in longevity of a corona treated image receptor medium. Though lab testing has shown some of these materials provide good ink adhesion after over two years of shelf life, there still remains a desire to have an image reception layer which does not require corona treatment.

Additional potential problems with corona treatment include decay due to improper storage conditions, the possibility of improper treatment due to corona treater malfunctions, lack of corona treatment due to forgetting to turn the treater on, and the fact that corona treatment can enhance "blocking" of some materials in roll form before they are adhesive coated. As known to those skilled in the art, "blocking" means the fusing of film layers which have been wound into a roll. The resulting "blocked" roll cannot be unwound and the material is unusable for the intended purpose.

The development of an image reception layer which does not require corona treatment would allow a wider process window in film production, and ensure that the material remains receptive to inks even with improper storage of the films before printing.

The invention is further illustrated by the following examples, but the particular materials and amounts thereof recited in these examples, as well as other conditions and details, should not be construed to unduly limit this invention.

Table 1 shows the formulation of Examples 1, 3, 9–12 and 16 and Comparison Examples 2C, 4C–8C, 13C and 15C. These formulations were used to make image receptor media having an image reception layer on a substrate layer, using the following extrusion techniques:

Each of the formulations was extruded on a 1.9 cm Brabender lab extruder, cast onto a 15.24 cm wide polyester carrier liner and solidified by passing through a chilled three roll stack.

Table 1 also shows qualitative test results of the ink adhesion of commercially available screenprint inks from Minnesota Mining and Manufacturing Company (3M) of St. Paul, Minn., USA after printing an image graphic using such ink on a 15 cm×30 cm size sample of the Example or Comparison Example formulation. The printing used the following technique:

A qualitative ink adhesion test as disclosed in U.S. Pat. No. 5,721,086 (Emslander et al.), incorporated by reference herein, was used to test each example. Generally, a test result of "poor" meant that ink adhesion failed whereas a qualitative test result of "good" meant that ink remained adhered to the imaging medium and passed the test.

TABLE 1

| Example # | Formulation | Adhesion for 1900 series 3M Inks | 3900 series 3M Inks | 9700 series 3M Inks |
|---|---|---|---|---|
| 1 | 100% DuPont Elvaloy 741 (No corona treatment) | Good | Good | Good |
| 2C | 100% DuPont Elvaloy 742 (No corona treatment) | Poor | Poor | Poor |
| 3 | 100% DuPont Elvaloy 4924 (No corona treatment) | Good | Good | Good |
| 4C | 100% DuPont Elvaloy HP441 (No corona treatment) | Poor | Poor | Poor |
| 5C | 100% DuPont Elvaloy HP662 (No corona treatment) | Poor | Poor | Poor |
| 6C | 100% DuPont Elvaloy AS (No corona treatment) | Poor | Poor | Poor |
| 7C | DuPont Bynel 3101 (Corona treated) | Good | Good | Good |
| 8C | DuPont Bynel 3101 (No corona treatment) | Poor | Good | Poor |
| 9 | 80/20 DuPont Bynel 3101/DuPont Elvaloy 741 (No corona treatment) | Good | Good | Good |
| 10 | Receptor formulation w/ UV stabilizer, pigment & antiblock (No corona treatment)<br>74 parts DuPont Bynel 3101<br>26 parts DuPont Elvaloy 741<br>20 parts Ampacet 11976 TiO2 concentrate<br>5 parts Polyfil MT5000 talc concentrate<br>5 parts Ampacet 10407 UV concentrate | Good | Good | Good |
| 11 | Receptor formulation w/ UV stabilizer, pigment & antiblock (No corona treatment)<br>Aged 1 week @ 120 F. then printed<br>74 parts DuPont Bynel 3101<br>26 parts DuPont Elvaloy 741<br>20 parts Ampacet 11976 TiO2 concentrate<br>5 parts Polyfil MT5000 talc concentrate<br>5 parts Ampacet 10407 UV concentrate | Good | Good | Good |
| 12 | Receptor formulation w/ UV stabilizer, pigment & antiblock (No corona treatment)<br>Exposed to UV curing unit 15 passes then printed<br>74 parts DuPont Bynel 3101<br>26 parts DuPont Elvaloy 741<br>20 parts Ampacet 11976 TiO2 concentrate<br>5 parts Polyfil MT5000 talc concentrate<br>5 parts Ampacet 10407 UV concentrate | NA | NA | Good |
| 13C | Elvax 265 (No corona treatment) | Poor | Poor | Poor |
| 14 | 80/20 Elvax 265/Elvaloy 741 (No corona treatment) | Good | Good | Good |
| 15C | Surlyn 1705-1 (No corona treatment) | Poor | Poor | Poor |
| 16 | 50/50 Surlyn 1705-1/Elvaloy 741 (No corona treatment) | Good | Good | Good |

Key:
Elvaloy 741 — Ethylene/vinyl acetate/carbon monoxide terpolymer — 24% vinyl acetate (VA), 10% CO from DuPont
Elvaloy 742 — Ethylene/vinyl acetate/carbon monoxide terpolymer — 28.5% vinyl acetate (VA), 9% CO from DuPont
Elvaloy 4924 — Ethylene/vinyl acetate/carbon monoxide terpolymer — 20.5% vinyl acetate (VA), 8% CO from DuPont
Elvaloy HP662 — Ethylene/carbon monoxide/n-butyl acrylate terpolymer — 30% n-butyl acrylate, 10% CO (different $MW_n$ than HP441) from DuPont
Elvaloy HP441 — Ethylene/carbon monoxide/n-butyl acrylate terpolymer — 30% n-butyl acrylate, 10% CO (different $MW_n$ than HP662) from DuPont
Elvaloy AS — Ethylene/proprietary acrylate/epoxy — no formulation available from vendor, resin supplied by DuPont
Bynel 3101 — Acid/acrylate modified ethylene vinyl acetate resin from DuPont
Elvax 265 — Ethylene vinyl acetate resin containing 28% vinyl acetate from DuPont
Surlyn 1705-1 — Ionomer resin from DuPont
Ampacet 11976 — TiO2 concentrate containing 50% TiO2 and 50% low density polyethylene. (from Ampacet Corp., Tarrytown, NJ)
Polyfil MT5000 — Talc concentrate containing 50% talc and 50% low density polyethylene (Polyfil Corp., Dover, NJ)
Ampacet 10407 — UV concentrate containing 10% hindered amine light stabilizer and 90% low density polyethylene (Ampacet Corp.)

Examples 1 and 3 and Comparison Examples 2C and 4C–6C show that of the Elvaloy™ brands of resin, only the ethylene vinyl acetate carbon monoxide terpolymers provide good ink adhesion, though not all ethylene vinyl acetate carbon monoxide resins do as shown by Example 2C which terpolymer contained undesirable additives that bloomed to the surface of the imaging layer and affected adhesion of ink.

Example 9 as compared with Comparison Examples 7C and 8C, show that corona treated Bynel 3101 resin (Example #7C) makes a good ink receptor, the non corona treated material (Example #8C) is a poor receptor, while the blend of 20% Elvaloy™ 741 (used in Example #1) to 80% Bynel 3101 (Example #9) results in a formulation with good ink receptivity.

Examples 10–12 show a typical receptor layer formulation including pigments, UV and antiblock additives. This formulation has good ink receptivity when produced (Example #10), after heat aging (Example #11) and after exposure to intense UV ink curing conditions (Example #12).

Comparison Example 13C shows an ethylene vinyl acetate copolymer (Elvax 265) that has a comparable vinyl acetate content as the Elvaloy™ 741 used in Example 1, but the Elvax 265 is not an effective ink receptor. This illustrates the fact that the carbon monoxide functionality plays a critical role in the adhesion of inks. This observation was reinforced by the performance of Example 14 which is the same as Example 13 but contains 20% of the Elvaloy™ 741 terpolymer, which made the blend an effective ink receptor.

Example 16 and Comparison 15C are extreme examples showing the effectiveness of the Elvaloy™ 741 terpolymer to promote ink receptivity. Surlyn 1705-1 ionomer (Comparison Example 15) is extremely difficult for the UV inks to stick to, but with a proper amount of Elvaloy™ 741 terpolymer blended in, (Example 16) the Surlyn 1705-1 ionomer also becomes an effective ink receptor, though the physical properties of the blend are compromised.

Results comparable to Examples 9–12 were obtained when Chevron SP 1305 ethylene methyl acrylate resin was substituted for the Bynel 3101 resin.

The above data indicate the effectiveness of ethylene vinyl acetate carbon monoxide terpolymers for ink adhesion. While not being limited to a particular theory, the increased polarity of these materials is believed to contribute to their effectiveness as ink receptors and the oxygen functionality of the carbon monoxide may somehow provide a reaction site for UV curable inks.

Ethylene-vinyl acetate copolymers do not work well as ink receptors without corona treatment as shown in Example #13C above. Nor do Ethylene-carbon monoxide copolymers work well. An experiment using Shell Carilon™ ethylene-carbon monoxide copolymers found that such copolymers extruded into a film and tested as in all of the examples 1–16 above had poor ink adhesion. Therefore, a terpolymer unexpectedly provides ink adhesion properties that neither combination of copolymers could.

The invention is not limited to the above embodiments. The claims follow.

What is claimed is:

1. A nonhalogenated image receptor medium comprising:

a substrate comprising a polymer, the substrate having two opposing major surfaces, wherein the polymer is selected from the group consisting of polyolefin, polyester, polyamide, acrylic, polystyrene, and polyurethane; and an image reception layer on a first major surface of the substrate, the image reception layer comprising an ethylene vinyl acetate terpolymer and having an outer surface for image reception.

2. The image receptor medium of claim 1, wherein the image reception layer further comprises at least one other polymer blended with the terpolymer, wherein the other polymer is selected from the group consisting of ethylene vinyl acetate resins, ethylene (meth)acrylic acid copolymer resins, polyethylene resins, polypropylene resins, ionomers, acid-modified or acid/acrylate modified ethylene vinyl acetates and a polymer comprising at least two monoethylenically unsaturated monomeric units, wherein one monomeric unit comprises a substituted alkene where each branch comprises from 1 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature, and combinations of such other polymers thereof.

3. The image receptor medium of claim 2, wherein the first monomeric unit is selected from the group of ethylene, propylene, butene, isobutylene, hexene, and octene; and wherein the second monomeric unit is selected from the group consisting of methyl(meth)acrylate, ethyl(meth) acrylate, butyl(meth)acrylate, 2-ethylhexyl acrylate, ethoxyethyl acrylate, hexyl acrylate, and the like.

4. The image receptor medium of claim 2 wherein the other polymer is selected from the group consisting of ethylene methyl acrylate and ethylene ethyl acrylate.

5. The image receptor medium of claim 1, further comprising an efficacious amount of free-radical scavenger.

6. The image receptor medium of claim 5, wherein the free-radical scavenger is a hindered amine light stabilizer.

7. The image receptor medium of claim 1, wherein the image reception layer comprises at least 5% by weight of the terpolymer.

8. The medium of claim 1 further comprising a prime layer on a second major surface of the substrate.

9. The image receptor medium of claim 8, wherein the prime layer comprises an ethylene vinyl acetate resin and a filler.

10. The medium of claim 8 further comprising an adhesive layer on the outer surface of the prime layer.

11. A nonhalogenated image receptor medium comprising a coextruded multilayered film, said multilayered film comprising:

a substrate layer comprising a polymer and having two opposing major surfaces, wherein the polymer is selected from the group consisting of polyolefin, polyester, polyamide, acrylic, polystyrene, and polyurethane; and an image reception layer on a first major surface of the substrate layer having an outer surface for image reception, said image reception layer comprising an ethylene vinyl acetate carbon monoxide terpolymer.

12. The image receptor medium of claim 11, wherein the polymer of the substrate layer is propylene-ethylene copolymer.

13. The image receptor medium of claim 11, wherein the image reception layer further comprises an efficacious amount of a free-radical scavenger;

wherein the image reception layer further comprises at least one other polymer blended with the terpolymer, wherein the other polymer is selected from the group consisting of ethylene vinyl acetate resins, ethylene (meth)acrylic acid copolymer resins, polyethylene resins, polypropylene resins, ionomers, acid-modified or acid/acrylate modified ethylene vinyl acetates and a polymer comprising at least two monoethylenically unsaturated monomeric units, wherein one monomeric unit comprises a substituted alkene where each branch comprises from 1 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature, and combinations of such other polymers thereof; and wherein the free-radical scavenger comprises a hindered amine light stabilizer present in an amount from about 0.2 to about 0.8 weight percent of the total image reception layer.

14. The image receptor medium of claim 13, wherein the other polymer is selected from the group consisting of ethylene methyl acrylate and ethylene ethyl acrylate.

15. A method of providing an image on a nonhalogenated image reception medium, the method comprising:

printing the image on the image receptor medium, the image receptor medium comprising:

a substrate comprising a polymer, the substrate having two opposing major surfaces, wherein the polymer is selected from the group consisting of polyolefin, polyester, polyamide, acrylic, polystyrene, and polyurethane; and an image reception layer on a first major surface of the substrate, the image reception layer comprising an ethylene vinyl acetate carbon monoxide terpolymer and having an outer surface for image reception.

16. The method of claim 15, wherein the printing is screen printing; and wherein the image reception layer further comprises at least one other polymer blended with the terpolymer, wherein the other polymer is selected from the group consisting of ethylene vinyl acetate resins, ethylene (meth)acrylic acid copolymer resins, polyethylene resins, polypropylene resins, ionomers, acid-modified or acid/acrylate modified ethylene vinyl acetates and a polymer comprising at least two monoethylenically unsaturated monomeric units, wherein one monomeric unit comprises a substituted alkene where each branch comprises from 1 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature, and combinations of such other polymers thereof.

17. The method according to claim 16, wherein the printing step comprises at least 5 exposures of the medium to ultra-violet light without significant loss of ink adhesion properties in the medium.

18. The method according to claim 16, wherein the printing step comprises at least 10 exposures of the medium to ultra-violet light without significant loss of ink adhesion properties in the medium.

19. A method of imaging comprising:

providing an image receptor medium; and screen printing an image on the image receptor medium, wherein the image receptor medium comprises an ethylene vinyl acetate carbon monoxide terpolymer.

20. The method of claim 19, the method further comprising exposing the medium to ultra-violet light.

21. A method of imaging comprising:

providing an image receptor medium;

screen printing an image on the image receptor medium; and exposing the medium to ultra-violet light without significant loss of ink adhesion properties in the medium, wherein the image receptor medium comprises an ethylene vinyl acetate carbon monoxide terpolymer.

22. An imaged article comprising:

an image receptor medium comprising an ethylene vinyl acetate carbon monoxide terpolymer; and an image on the image reception layer, the image comprising a screen printing ink.

23. The article of claim 22 wherein the screen printing ink is curable by exposure to ultra-violet radiation.

24. The article of claim 22 wherein the screen printing ink has been cured by ultra-violet radiation.

* * * * *